US005699979A

United States Patent [19]

Spada et al.

[11] Patent Number: 5,699,979

[45] Date of Patent: Dec. 23, 1997

[54] MACHINE OF THE TYPE CAPABLE OF USING STRIPS OF MATERIAL WOUND IN REELS

[75] Inventors: Walter Spada, Marzabotto; Gian Luigi Gherardi, Medicina, both of Italy

[73] Assignee: Sasib S.p.A., Bologna, Italy

[21] Appl. No.: 540,454

[22] Filed: Oct. 10, 1995

[30] Foreign Application Priority Data

Oct. 26, 1994 [IT] Italy ..... GE94A0119

[51] Int. Cl.[6] ..... B65H 19/00; B65H 75/24

[52] U.S. Cl. ..... 242/559.3; 242/573.7; 242/563.2; 242/564

[58] Field of Search ..... 242/559.3, 559, 242/573.7, 563.2, 564

[56] References Cited

U.S. PATENT DOCUMENTS

| | | | |
|---|---|---|---|
| 3,430,883 | 3/1969 | Charneski et al. | 242/573.7 |
| 3,456,893 | 7/1969 | Michelson | 242/573.7 |
| 3,934,836 | 1/1976 | Dunlap et al. | 242/573.7 |
| 4,267,985 | 5/1981 | Rogers | 242/559 |
| 4,553,712 | 11/1985 | Krywiczanin et al. | 242/58 |
| 4,589,811 | 5/1986 | Riccardo et al. | 414/224 |
| 4,853,742 | 8/1989 | Payrhammer et al. | 355/27 |
| 4,913,366 | 4/1990 | Andou | 242/563.2 |
| 5,285,978 | 2/1994 | Sakano et al. | 242/559.3 |

FOREIGN PATENT DOCUMENTS 37 34 896 4/1989 Germany .

*Primary Examiner*—John Q. Nguyen
*Attorney, Agent, or Firm*—Larson & Taylor

[57] ABSTRACT

A machine of the type capable of using strips of material wound in reels, for example wrapping, packaging and cellophane wrapping machines for cigarettes, or similar, the machine comprising at least one unwinding spindle of a reel of a strip of material which is supported in or which may be brought into a predetermined unwinding operating position; a store for at least one further reel to replace the empty reel on the spindle; means of transferring one replacement reel at a time from the store to the unwinding spindle in the operating position. The unwinding spindle is integrated with the store and forms its end on the output side. Advantageously, the store consists of a supporting bar on which the cores of the reels are threaded and whose front free end carries the spindle coaxially.

15 Claims, 6 Drawing Sheets

MACHINE OF THE TYPE CAPABLE OF USING STRIPS OF MATERIAL WOUND IN REELS

BACKGROUND AND SUMMARY OF THE INVENTION

The invention relates to a machine of the type capable of using strips of material wound in reels, for example wrapping, packaging and cellophane wrapping machines for cigarettes, or similar, the machine comprising:

at least one unwinding spindle of a reel of a strip of material which is supported in or which may be brought into a predetermined unwinding position;

a store for at least one further reel to replace the empty reel on the spindle;

means of transferring one replacement reel at a time from the store to the unwinding spindle in the operating position.

In particular, machines for the tobacco processing industry, such as wrapping machines, packaging machines or cellophane wrapping machines for cigarettes, or similar, are made so that they operate at high speeds. This entails a high consumption of wrapping paper or materials for packaging or for cellophane wrapping, and these materials are therefore provided in the form of a strip wound on reels which are of considerable dimensions and generally very heavy. The reel replacement operation is not very frequent, but because of the great weight is generally very difficult for the operator.

The object of the invention is to produce a machine of the type described initially, in order to make the operations of replacing the reels of material more convenient and, especially, less frequent, with the use of relatively simple means which operate reliably.

The invention resolves this problem with a machine of the type described initially, in which the unwinding spindle is integrated with the store and forms its end on the output side.

In a preferred embodiment, the store is provided behind the unwinding spindle and has means of housing one or more replacement reels disposed in line, one behind the other, behind the spindle and substantially coaxially with it, while the transfer means are driven in steps matched to the movement of one reel at a time onto the unwinding spindle, solely by the axial traversing of the reels.

Advantageously, the store consists of a supporting bar on which the cores of the replacement reels can be threaded and which carries at its free front end the unwinding spindle as an axial, particularly substantially coaxial, extension.

Consequently, when the unwinding reel is empty, the new reel may be threaded onto the unwinding spindle by simple axial traversing from the rear of the spindle.

When the reels are provided with cores, it is unnecessary to provide suitable means for discharge of the cores from the unwinding spindle, since the new reel, which is threaded on the spindle from the rear, automatically pushes forward the core of the empty reel, removing it from the front end of the spindle.

Positioning means may be provided on the unwinding spindle for the correct positioning of the reel on the spindle, and/or in combination with the spindle for the correct positioning of the spindle and reel with respect to the following processing units which use the strip of material.

BRIEF DESCRIPTION OF THE DRAWINGS

The invention also relates to other characteristics which further improve the machine described above and which form the subject of the dependent claims.

The particular characteristics of the invention and the advantages derived from it will be made clearer by the description of certain preferred embodiments, illustrated by way of example and without restriction in the attached drawings, in which.

DESCRIPTION OF THE PREFERRED EMBODIMENT OF THE INVENTION

Figure 1:
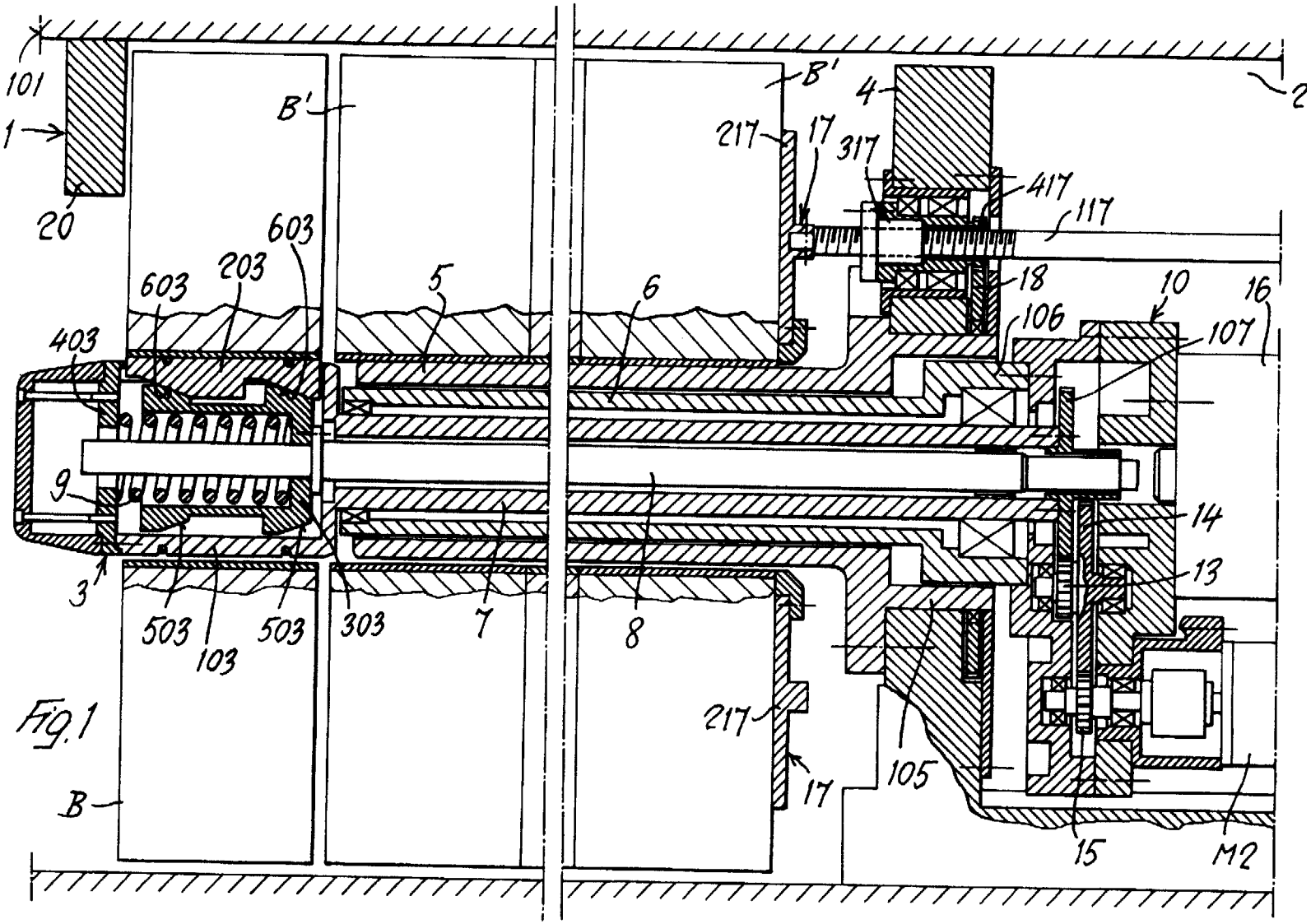
FIG. 1 shows an axial section of a first embodiment of the machine according to the invention.
Figure 2:
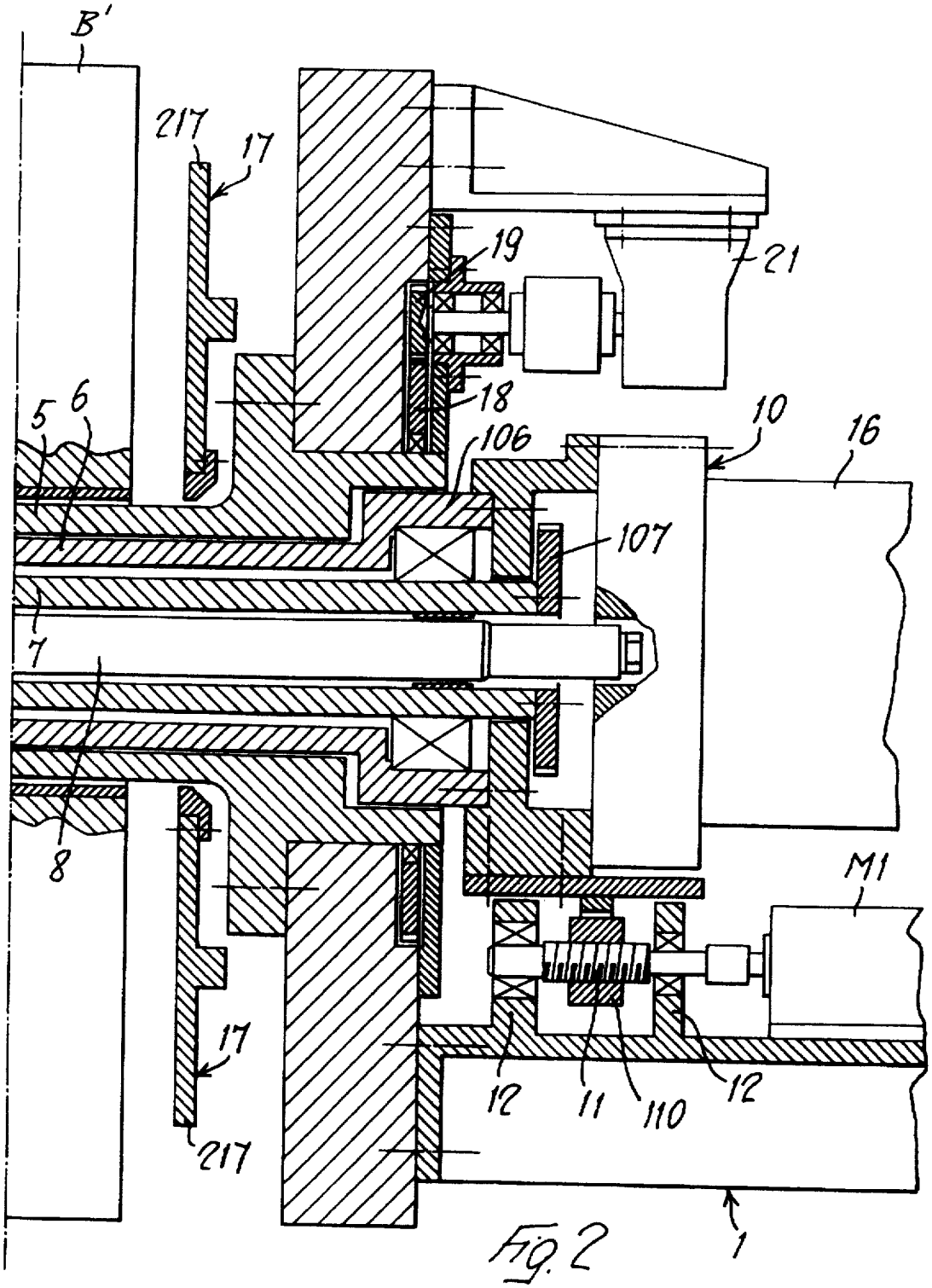
FIG. 2 shows an enlarged axial section of the rear end of the store of the machine as shown in FIG. 1.
Figure 3:
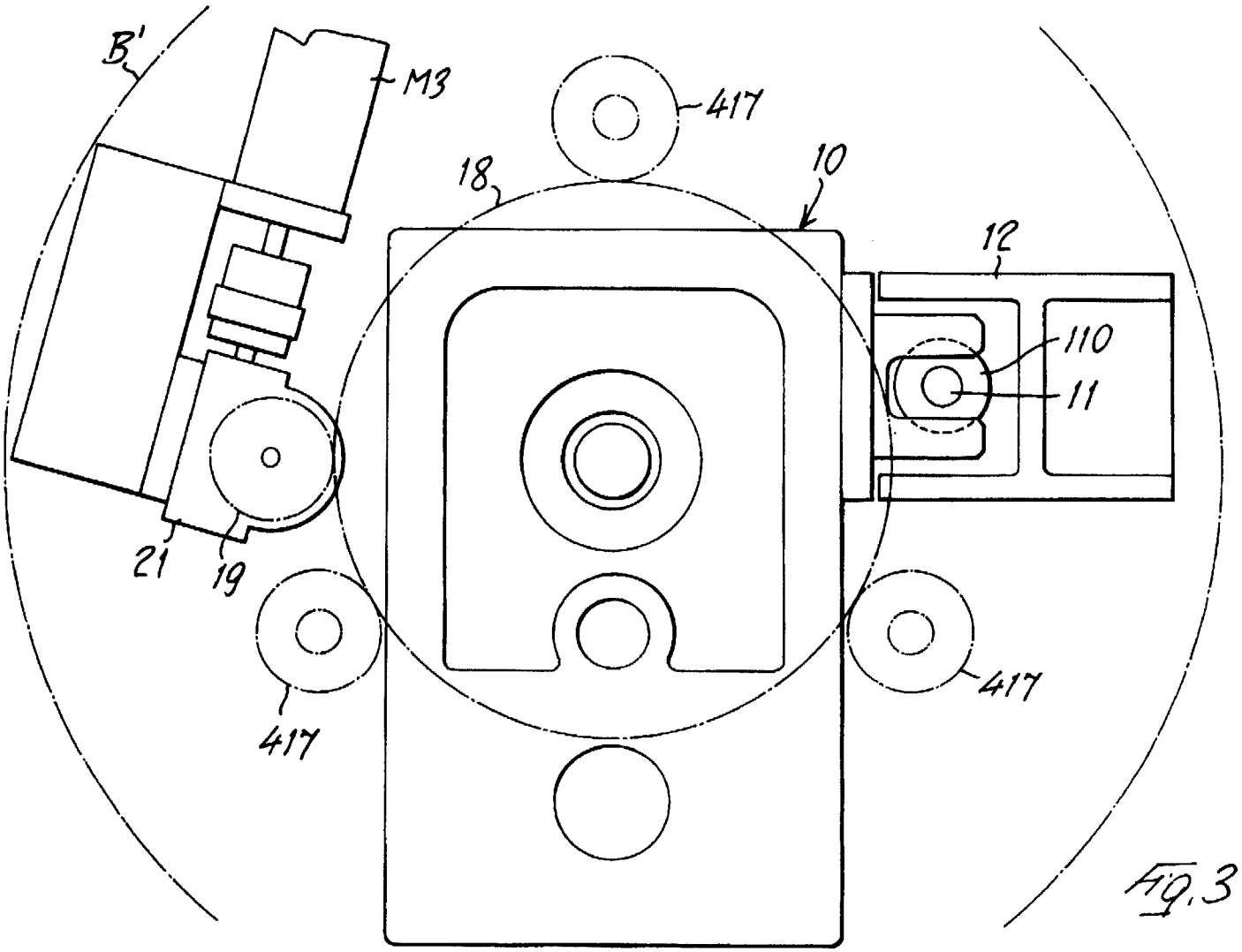
FIG. 3 shows a view, in the direction of the axis of the store, of the rear end of the store as shown in FIGS. 1 and 2.

With reference to FIGS. 1 to 3, a machine 1 according to the invention has a tube 2, for housing replacement reels B', which is orientated substantially coaxially with the unwinding spindle 3 in its unwinding position. In particular, the tube 2 extends between the two frontal faces of the machine 1 and opens on the frontal face 101 known as the forward face, on which most of the processing units using the strip of material are disposed. In the tube 2, a supporting bar 5, which is orientated substantially coaxially with the tube 2, is carried by a fixed end wall 4 of the tube so that it projects towards the open end of the tube 2 on the forward frontal face 101 of the machine 1. The cores of the replacement reels B' are threaded on the supporting bar 5, while the free front end of the supporting bar 5 carries, as a substantially coaxial extension, the unwinding spindle 3. The supporting bar 5 is disposed in such a way that the unwinding spindle 3 is in its predetermined operating position of unwinding the strip of material from a reel B locked on it. The supporting bar 5 has a diameter substantially corresponding to that of the spindle 3, at least over part of its transverse section, and is made tubular, with an internal hole of cylindrical section. A first tubular cylindrical sleeve 6 is housed inside the supporting bar 5 so that it is axially slidable with respect to the supporting bar, the sleeve 6 extending from one end to the other of the tubular supporting bar 5 and housing inside it, rotatably but not axially movably with respect to the sleeve, a coaxial tubular shaft 7 for rotating the spindle 3. The front end of the tubular rotary drive shaft 7, projecting beyond the supporting bar 5, is integral with the cylindrical body 103 of the unwinding spindle 3. A cylindrical rod 8 for transmitting the axial motion to operate the grippers 203 of the spindle 3, to lock the reel core, extends coaxially inside the tubular rotary drive shaft 7 of the spindle 3. The front end of the transmission rod 8 extends coaxially inside the cylindrical body 103 of the spindle 3 and engages, and may be moved jointly, with a sliding cup 303, which is supported coaxially movably inside the body 103 of the spindle. The sliding cup 303 houses a Belleville washer 9 which is interposed between the rear closed wall of the sliding cup 303 and an opposite fixed wall 403 on the front end of the body of the spindle 3, and which opposes the axial forward traversing of the sliding cup 303 and the transmission rod 8. On its radially external face, the sliding cup 303 has conical surfaces or surfaces in the form of inclined planes 503, which interact with conjugate internal radial appendages 603 of the grippers 203 of the spindle, which are supported so that they are radially movable in the body 103 of the spindle. The rotary drive means of the spindle 3, the operating means of the grippers 203 and the means of axially sliding the sleeve 6 inside the supporting bar 5 are provided at the rear end of the supporting bar 5. The rear end 106 of the slidable sleeve 6, projecting beyond the supporting bar 5 and behind the fixed end wall 4 of the tube 2, carries, in such a way that they are slidable together with the said sleeve 6, the mechanisms for rotating the spindle 3 and for operating its grippers 203, these mechanisms being enclosed in a housing 10 fixed to the said rear end. The box 10 carries a lateral projecting fixed nut 110 in which is engaged a screw 11 which is mounted rotatably in brackets 12 integral with the frame of the machine 1 and which is rotated by a motor M1. In this way the rotation of the screw 11 causes an axial movement of the slidable sleeve 6 with respect to the fixed supporting bar 5.

The tubular rotary drive shaft 7 terminates at the rear end in a gear 107 which is provided behind the rear end of the slidable sleeve 6 and which is connected dynamically, inside the housing 10, through a reduction gear train 13, 14, to a pinion 15 driven by a motor M2. The motor M2 is also carried on the housing 10. The transmission rod 8 projects beyond the rear end of the rotary drive shaft 7 and is connected rotatably with respect to the shaft but in such a way that it can be moved axially together with the shaft by the piston of a cylinder and piston unit 16 which is carried on the rear face of the housing 10 and which may be of a hydraulic, pneumatic or similar type.

Transfer means, in other words axial pushers, of the replacement reels B' are provided behind the reels. These means may be made in any form. In the embodiment shown in FIGS. 1 to 3, to ensure that the replacement reels B' are perfectly parallel to each other in their axial traverse, a plurality of axial pushers indicated overall by 17 is provided, and the pushers are distributed at equal angular intervals over the extension of the transverse section of the reels B', in other words over the face of the reel. In particular, each pusher consists of a threaded rod 117 which is parallel to the supporting bar 5 and to the axis of the reels, and which has a bearing plate 217 at its front end facing the rear reel. The threaded rod 117 is supported non-rotatably in a coincident slot in the fixed end wall 4 and is engaged in a nut 317 which is supported rotatably in the associated slot of the fixed end wall 4. Each nut 317 has an externally toothed axial extension 417 which is engaged with a common internal ring gear 18. The ring gear 18 is supported so that it is freely rotatable coaxially inside the rear end 105 of the supporting bar 5 and is rotated by means of a drive pinion 19 which is driven by a motor M3 fixed to the fixed end wall 4. The motor M3 is orientated with its axis substantially tangential to the ring gear 18 and is connected to the drive pinion 19 of the ring gear by means of an angled reduction gear unit 21.

Stops to position the reel B on the unwinding spindle 3 may be provided at the front end of the tube 2. In the example illustrated in FIGS. 1 to 3, there is a fixed transverse stop 20 which projects radially inwards from a peripheral wall of the tube 2 and which interacts with the radially external peripheral area of the full reel B on the spindle 3.

Motors M1 to M3 may advantageously be controlled in a known way from the machine control unit. In this case, the operation is as follows. When a reel on the spindle 3 is empty, the spindle 3 is stopped. The spindle may be stopped automatically, by devices detecting the end of the strip of material or the reduction of the diameter of the reel being unwound, or similar, which are normally used for this purpose. After the spindle 3 has been stopped, the pushers 17 are operated and move the line of replacement reels B' on the supporting bar 5 in such a way that a new reel B is threaded from the rear of the supporting bar onto the spindle 3. This reel pushes the core of the empty reel forwards so that it is axially disengaged from the front end of the spindle 3. Since it has to be possible for the reel being unwound on the spindle 3 to be made to rotate with respect to the replacement reels B' on the supporting bar 5, it is necessary for this reel to be axially separated from the reel remaining immediately behind on the end of the supporting bar 5.

For this purpose, the front end of the supporting bar 5 is located in such a position relative to the predetermined operating position of the unwinding spindle 3 that the rear end of the spindle 3, in its operating position, is axially separated from the said end of the supporting bar 5. By means of the slidable sleeve 6, the spindle 3 can be moved axially from the said predetermined operating position to a rear position against the facing end of the supporting bar 5. The path of the axial separation of the spindle 3 from the end of the supporting bar 5 is chosen in such a way that at the time of the axial transfer of the new reel to the spindle 3, in the rear position of the spindle, the following reels B' on the supporting bar 5, which bear on each other and on the new reel B', bring the new reel to the correct position with respect to the spindle 3. The spindle 3 is then moved axially forwards to the alignment position defined by the positioning stop 20. As illustrated in FIG. 1, this causes the reel B on the spindle to be spaced apart from the immediately following reel B' on the front end of the supporting bar 5. Simultaneously, the rear part of the spindle 3, which was superimposed on a short section of the spindle 3 to push the reel B into the correct position for gripping, is also withdrawn from the core of the said following reel B'. As shown in FIG. 1, the first replacement reel B' on the front end of the supporting bar 5 projects slightly from the said end. Additionally, to facilitate the insertion of the spindle 3 into the said projecting part of the replacement reel B' when the spindle again moves back against the supporting bar 5 for the transfer of the reel to the spindle 3, the rear end of the spindle 3 is made with a conical flare.

Figure 6:
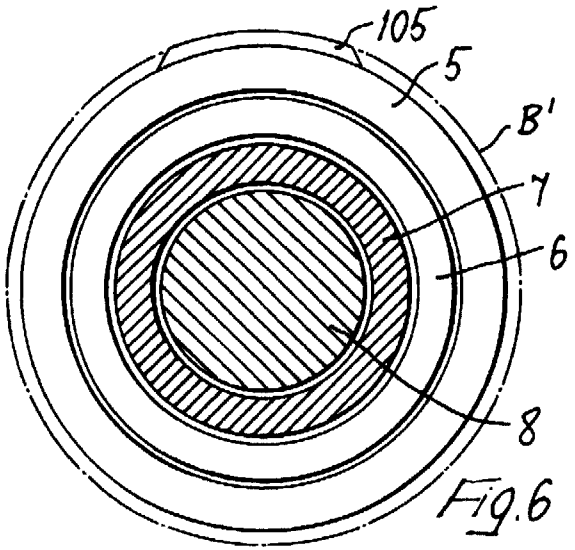
FIG. 6 shows a section of the supporting bar for the replacement reels, usable in both embodiments as shown in the preceding figures.

With reference to FIG. 6, since the reels B', owing to the necessary difference between the external diameter of the supporting bar 5 and the internal diameter of the cores, cannot be supported on the bar in a position perfectly coaxial with it and with the spindle 3, a radial expansion 105 to support the reels B' is provided on the upper face of the supporting bar 5 substantially in the area in which the cores are supported on it, the expansion having a thickness such that its radius of curvature corresponds to the internal radius of curvature of the cores of the reels B', so that the cores, being supported on the said upper radial expansion 105, become disposed coaxially on the supporting bar 5 and on the spindle 3, while maintaining the contact surface and therefore the frictional forces within the limit of acceptable values. This expansion may consist of a fixed surface as illustrated in FIG. 6, or one or more adjacent axially tapered rollers fitted so that they are rotatable about axes tangential to the supporting bar 5.

Figure 8:
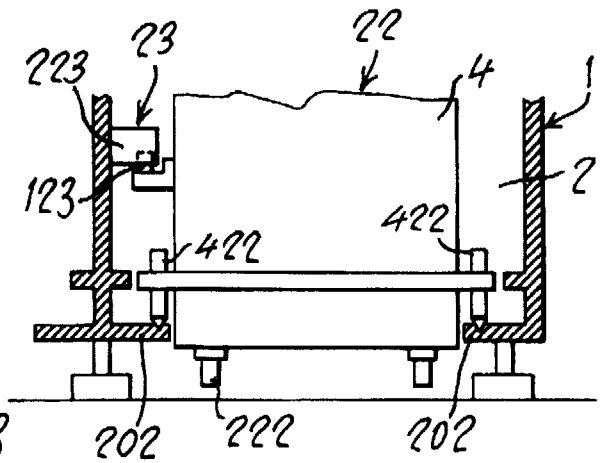
FIGS. 7 and 8 show a variant embodiment of the machine according to the embodiment shown in FIGS. 1 to 3.
Figure 7:
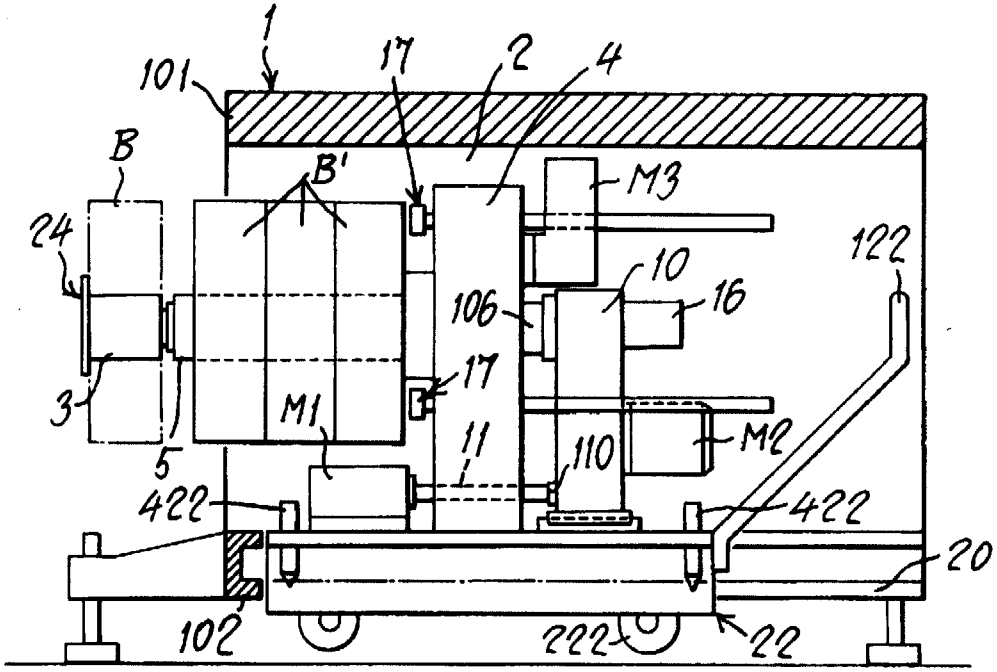

FIGS. 7 and 8 show a variant of the embodiment shown in FIGS. 1 to 3. In this variant, the supporting bar 5 for the replacement reels B' and the unwinding spindle 3, together with the associated drive units and pusher means 17, are not fitted in a fixed way inside the tube 2, but the end wall 4 of the said tube 2 to which the said parts are fixed is supported movably. In a first variant, not illustrated, it may be fitted on a slider movable forwards and backwards inside the tube 2, to facilitate the manual loading of the replacement reels B' on the supporting bar 5. In the embodiment illustrated, however, the end wall 4, or the supporting bar 5, together with the unwinding spindle 3 and all the driving and operating mechanisms associated with them, are fitted on a carriage 22 provided with wheels 222 and handlebars 122 which can be introduced into the tube 2, in this particular case from the rear end of the tube. Positioning stops 102 for the carriage 22, interacting with parts of the carriage framework, may be provided in the tube 2. The tube 2 may also be advantageously provided with means 202 of guiding the carriage 22, which ensure the correct positioning of the axis of the spindle 3 and of the supporting bar 5 with respect to the section of the tube 2. In the example illustrated, the guide means 202 consist of longitudinal guides disposed along the lateral walls of the tube 2 and interacting with the sides of the carriage 22. According to a further characteristic, to ensure control of the synchronization of the unwinding spindle with the operations of transferring the replacement reels B' from the supporting bar 5 to the spindle 3 by means of the central unit of the machine 1, the control lines of the motors M1, M2, M3 and of the actuator 16 operating the grippers of the spindle 3 are connected to the central unit of the machine 1 by means of an automatic connector 23, of which one part, 123, is provided in a predetermined position on the carriage 22, while the other part, 223, is fixed in a position axially coincident with the first, 123, on the wall of the tube 2. According to a further improvement, in order to prevent the vibrations during the stage of unwinding of the reel B or during the stage of transfer of the reels B' from causing a movement of the carriage 22 with respect to the tube 2, it is possible to provide means of locking the carriage 22 in position in the tube 2. In the example illustrated, the carriage 22 is provided with extendable legs 422 which interact with lateral shelves of the tube 2, consisting in particular of the lateral guides 202, which cause the wheels 222 of the carriage 22 to be raised from the bottom of the tube 2. In particular, the supporting ends of the extendable legs 422 are shaped in such a way that they engage in corresponding housings of the supporting shelves to provide self-centring. In particular, the supporting ends of the legs 422 are conically tapered and engage in complementary conical cavities. The legs 422 may be extended manually or automatically, for example by means of mechanical, hydraulic or similar actuators.

In the example shown in FIGS. 7 and 8, a stop for the axial positioning of the reel B on the spindle 3 in the correct unwinding position is also provided and is fitted on the spindle 3, in the form of an annular expansion 24, preferably removable and located at the free front end of the spindle 3. The activation or deactivation of the positioning stop 24, which may for example comprise blades oscillating between a radially external position and a radially withdrawn position (see also FIG. 4) may be carried out in synchronization with the operation of the grippers of the spindle 3 by the same actuating means.

The correct axial positioning of the spindle for the alignment of the reel B with the processing units of the machine provided down-line from the reel may be obtained by means of positioning stops or similar, in a way which is similar to the preceding example and which is not illustrated in detail with reference to this variant.

Figure 4:
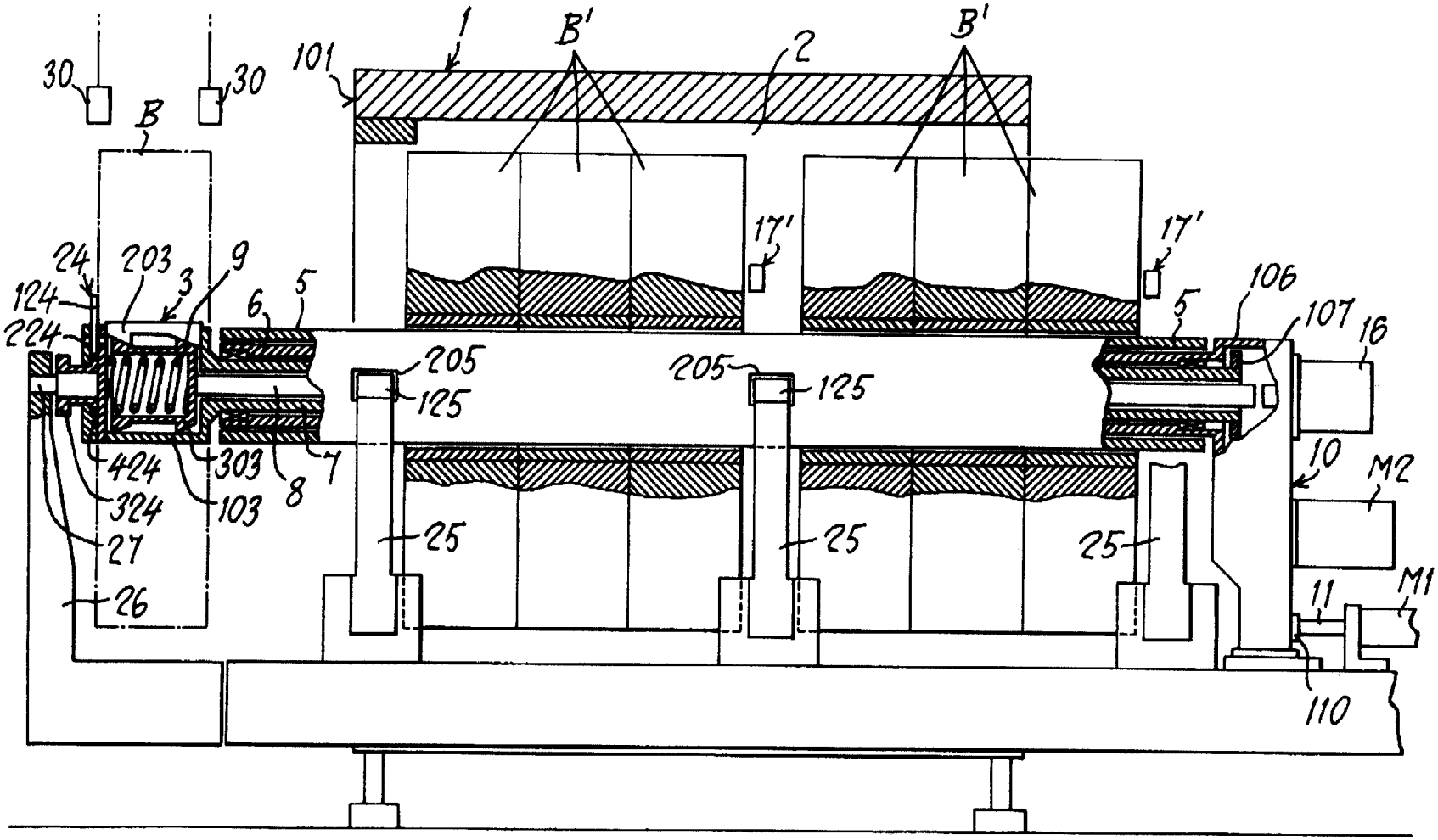
FIG. 4 shows in a similar way to FIG. 1 a second embodiment of the machine according to the invention.
Figure 5:
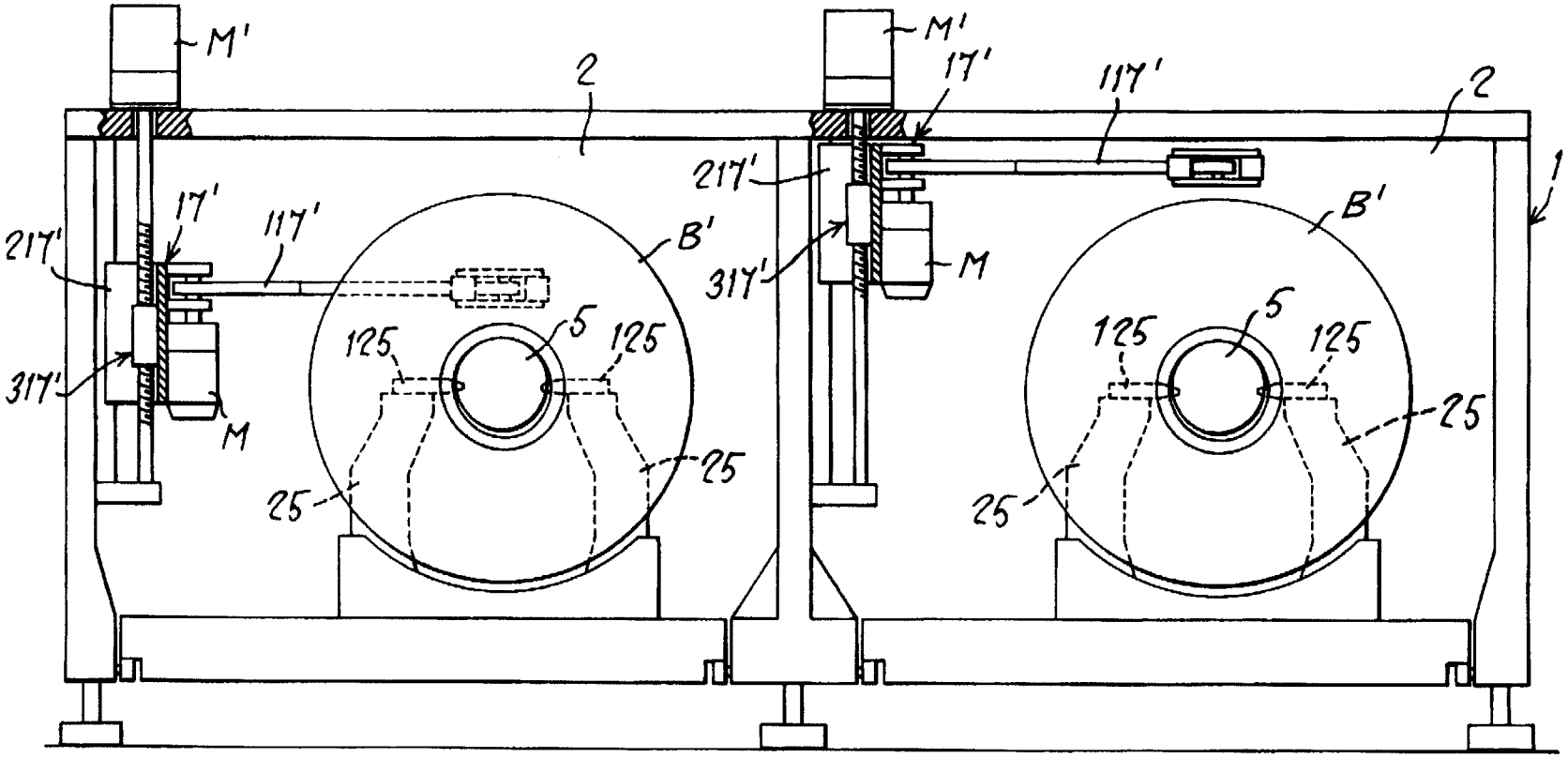
FIG. 5 is a view of the frontal face of a machine as shown in FIG. 4, restricted to the area in which two stores for the reels are provided.

FIGS. 4 and 5 show a further embodiment of the invention. This further embodiment differs from the preceding ones in that the supporting bar 5 is not projecting but is supported by a plurality of pairs of opposing lateral supporting brackets 25 which are distributed at substantially equal intervals along it. It is advantageous to provide at least three pairs of lateral opposing brackets 25 which divide the bar 5 into two support segments. The supporting brackets 25 of each pair may be oscillated between the position of engagement with the bar 5 and the position of disengagement from the bar in which they do not interfere with the replacement reels B'. The supporting brackets 25 are provided at their free ends with radial pins 125, which in the raised position of engagement with the bar 5 engage the interior of coincident lateral notches 205 which are made on the sides of the support bar 5, are diametrically opposed and face the supporting brackets 25. The notches 205 and the pins 125 are preferably of conical or truncated conical form, to ensure a centering action and to limit play. The brackets 25 are made to open in such a way that at least two pairs of brackets 25 always remain in the position of engagement with the supporting bar 5. Two pairs of brackets are provided in the end areas of the supporting bar 5 and one pair is provided in the intermediate position. The front pair of supporting brackets 25 is disposed in such a way that the supporting bar projects beyond the pair by an amount sufficient to hold at least one further replacement reel B'. Each segment of the supporting bar 5 is associated with an axial pusher 17' for the group of replacement reels B' provided on it. Each axial pusher 17' consists of an arm 117' which is supported so that it can oscillate in a horizontal plane parallel to the axis of the supporting bar 5 on a vertical slider 217'. The oscillating arm 117' projects transversely inside the tube 2 and behind the corresponding row of replacement reels B' and may be moved between a position behind the reels B' and a position above them. The pusher arm 117' is made to oscillate by a motor M on the slider 217', while the slider is made to slide by a motor M' and a screw and nut transmission 317'.

During the operating phase of the machine, the front pair of supporting brackets 25 remains constantly open, so that the device operates substantially as illustrated previously. The supporting bar is held up by the two further pairs of brackets 25 which remain in a position of engagement with it. As a variant form of operation it is also possible to make the replacement reels B', behind the reel B pushed onto the unwinding spindle 3, be returned to the position behind the brackets 25 by the pushing means 17' associated with them, after the new reel B has been gripped by the unwinding spindle 3 and following the axial separation of the spindle from the front end of the supporting bar 5. This may be advantageous in the case of very heavy reels, enabling the supporting bar 5 to be supported at its front end during the unwinding rotation of the reels. However, this arrangement is not absolutely necessary.

In both types of operation, it may be advantageous to provide a removable front supporting bracket 26 which has a socket for mutually rotatable engagement with a coaxial front pin 27 projecting from the front end of the unwinding spindle 3. The bracket 26 must be disengaged from the unwinding spindle 3 and brought into a position in which it permits the disengagement of the core of the empty reel from the spindle during the phase of the transfer of the following replacement reel B'. This may take place manually or automatically.

When the front segment of the supporting bar 5 is vacant, the front brackets 25 are brought into engagement with the supporting bar 5 and the intermediate pair of brackets 25 is then opened. The replacement reels B' are transferred from the rear to the front segment and the intermediate brackets 25 can be returned to the position of engagement with the supporting bar 5, making it possible to open the front brackets 5 for the execution of the replacement procedure as described above. This embodiment as shown in FIGS. 4 and 5 has the advantage of providing a supporting bar 5 of greater length than in the preceding embodiments and therefore of enabling a greater number of replacement reels B' to be housed in the store, thus further decreasing the number of store loading operations.

In this embodiment also, the unwinding spindle 3 is provided with a stop for the axial positioning of the reels, which consists, similarly to that described with reference to the variant shown in FIG. 6, of a plurality of blades 124 which can be oscillated in the form of an iris about axes 224 parallel to the axis of the spindle 3 from a position radially withdrawn into the unwinding spindle 3 to a position of radial projection from the spindle. The blades 124 may be made to oscillate either manually, as in the case illustrated, where a rotatable handle 324 is provided to drive a coaxial gear 424 engaging with the toothed sectors of the blades 124.

In this example also, means are provided for the correct alignment positioning of the unwinding spindle 3 and therefore of the reel B on the spindle with respect to the following processing units of the machine 1. In this case, by contrast with the previous description, sensors, for example light barriers 30 or similar which detect the position of the reel B on the spindle 3 and which control the motor M1 driving the unwinding spindle 3 in its axial movement with respect to the fixed supporting bar 5, are provided in place of the positioning stop 20.

With reference to FIG. 5, in the case of any of the preceding embodiments, the machine 1 may also have a plurality of stores for the same type of reels of material or for different types of reels of material, provided in the appropriate areas of the machine. In particular, when a type of strip of material has a high rate of use it is possible to provide for the same type of reels of material two stores of the type described above which are disposed in tubes 2 adjacent to each other, each of the tubes having a supporting bar 5 with its own unwinding spindle 3, while the two stores may be associated with automatic means of taking the strip of material from a full reel on one spindle 3 and of joining the leading portion of the material to the trailing end of the strip of material of an emptying reel on the other spindle 3. The said means may advantageously be disposed so that they do not interfere with the operations of refilling one of the two stores from the front, during the unwinding of the strip of material from the reels of the other store thus making it possible to avoid stoppages of the machine.

Obviously, it is also possible to provide combinations of the illustrated embodiments. For example, a supporting bar 5 may be carried both by a wall (4) from which its rear end projects and by one or more pairs of supporting brackets 25 which interact with the projecting portion of the bar 5. Additionally, both in this case and in the embodiment shown in FIGS. 1 to 3, a front supporting bracket 26 may be associated with the supporting bar 5.

We claim:

1. A machine for using strips of material wound in reels comprising:

a base;

a hollow supporting bar having a longitudinal axis, a front end and a rear end, said supporting bar having a plurality of reels stored thereon;

a bar supporting means for supporting said supporting bar relative to said base;

a tubular sleeve having a front end and a rear end;

a sleeve mounting means for mounting said tubular sleeve inside said supporting bar for axial movement in said supporting bar between an unwinding position and a transfer position;

a tubular shaft having a front end and a rear end, said front end including a spindle on which a reel is mounted for unwinding and a core engaging means for selectively engaging a core of the reel mounted on said spindle;

a shaft mounting means for mounting said tubular shaft inside said tubular sleeve for rotation about the longitudinal axis of said supporting bar with said spindle extending axially beyond said front end of said supporting bar coaxial with said supporting bar;

a transmission rod having a front end which engages said core engaging means for selective actuation thereof and a rear end;

a rod mounting means for mounting said transmission rod inside said tubular shaft for rotation with said tubular shaft and for axial movement relative to said tubular shaft;

a sleeve moving means connected to said rear end of said tubular sleeve for moving said tubular sleeve axially in said supporting bar between the unwinding and transfer positions thereof together with said tubular shaft and said transmission rod such that said spindle is also moved between an unwinding position spaced from said supporting bar and a transfer position immediately adjacent said supporting bar;

a shaft rotating means carried by said rear end of said tubular sleeve and connected to said tubular shaft for rotating said tubular shaft in said tubular sleeve and hence said spindle extending beyond said supporting bar when said sleeve and hence said spindle are in the unwinding positions thereof;

a rod moving means carried by said rear end of said tubular sleeve for axially moving said transmission rod in said tubular shaft when said sleeve and hence said spindle are in the transfer positions thereof and hence for causing said core engaging means to move between an engaged position with an adjacent core and a disengaged position with the adjacent core; and a pusher means for selectively pushing a front-most one of the reels from said supporting bar onto said spindle when said spindle is in the transfer position and said core engaging means is in the disengaged position, whereby an empty core is simultaneously moved from said core engaging means, and whereby after transfer of the front-most reel to said core engaging means said rod moving means moves said transmission rod so that said core engaging means is moved back to the engaged position and then said sleeve moving means is moved back to the unwinding position together with said spindle so that the front-most reel is then axially separated from a remainder of the reels stored on said supporting bar.

2. A machine for using strips of material wound in reels as claimed in claim 1:

wherein the plurality of reels stored on said supporting bar are provided in an abutting arrangement; and wherein said pusher means pushes all of the abutting reels as a unit by engaging a rear-most one of the reels.

3. A machine for using strips of material wound in reels as claimed in claim 1, and further including:

a first positioning means for positioning the front-most reel precisely on said spindle; and a second positioning means for positioning said spindle, with the front-most reel precisely positioned thereon, precisely with respect to said base.

4. A machine for using strips of material wound in reels as claimed in claim 3:

wherein said first positioning means includes a member which is attached to said spindle and which is movable between an engaging position where the front-most reel is axially engaged by said member when said pusher means pushes the front-most reel onto said spindle and a clearing position where the front-most reel is not axially engaged by said member.

5. A machine for using strips of material wound in reels as claimed in claim 1:

wherein said bar supporting means fixes said bar immovably with respect to said base.

6. A machine for using strips of material wound in reels as claimed in claim 1:

wherein said supporting bar has a circular cross section with a first diameter; and wherein said spindle has, in cross section, an angular sector at an upper face thereof and a remaining sector, said angular sector having a sector diameter which matches said first diameter and which is coaxial with an adjacent upper portion of said supporting bar, and said remaining sector being generally circular and having a second diameter smaller than said first diameter.

7. A machine for using strips of material wound in reels as claimed in claim 1:

wherein said bar supporting means is a carriage which is movable with respect to said base and which includes a means for positioning said carriage with respect to said base;

wherein said shaft rotating means and said pusher means each include a control line, and a control unit attached to said base to which said control lines are to be connected when said carriage is in an unwinding position; and further including an automatic connector means for automatically connecting said control lines to said control unit when said carriage is in the unwinding position.

8. A machine for using strips of material wound in reels as claimed in claim 7:

further including a locking means for locking said carriage in position with respect to said base after said carriage is positioned by said positioning means.

9. A machine for using strips of material wound in reels as claimed in claim 1 wherein said bar supporting means includes:

at least one or more pairs of opposing brackets; and a respective moving means for each respective pair of brackets for moving the respective said pair of brackets between an active supporting position in which the respective pair of brackets engage said supporting bar at diametrically opposite lateral points and an inactive position in which the respective pair of brackets is spaced from said supporting bar allowing a reel pushed by said pusher means to move axially thereby.

10. A machine for using strips of material wound in reels as claimed in claim 9:

wherein there are only three of said pairs of opposing brackets located respectively at said front end, said rear end, and an intermediate location between said front and rear ends of said supporting bar.

11. A machine for using strips of material wound in reels as claimed in claim 9:

wherein said pusher means includes at least two axial pushers spaced axially along said base, each said axial pusher being positioned to forwardly push a group of reels mounted on said supporting bar from a position in front of an adjacent respective said pair of opposing brackets.

12. A machine for using strips of material wound in reels as claimed in claim 11:

wherein each said axial pusher is movable radially with respect to said supporting bar between a position where said axial pusher axially engages a reel mounted on said supporting bar and a position where said axial pusher does not axially engage a reel mounted on said supporting bar.

13. A machine for using strips of material wound in reels as claimed in claim 1 wherein said bar supporting means includes:

a coaxial extension which extends frontally from said spindle;

a bracket which extends from said base and which engages said extension to support said front end of said supporting bar during rotation by said shaft rotating means and during axial movement by said sleeve moving means; and a bracket moving means for moving said bracket between an engaged position where said bracket is engaged with said coaxial extension and a disengaged position where said bracket is disengaged from said coaxial extension such that the empty core is moved from said spindle free of said bracket.

14. A machine for using strips of material wound in reels as claimed in claim 1:

wherein said base includes first and second base portions, (a) said first base portion having associated therewith first ones of said supporting bar, said bar supporting means, said tubular sleeve, said sleeve mounting means, said shaft mounting means, said transmission rod, said rod mounting means, said sleeve moving means, said shaft rotating means, said rod moving means, and said pusher means, and (b) said second base portion having associated therewith second ones of said supporting bar, said bar supporting means, said tubular sleeve, said sleeve mounting means, said shaft mounting means, said transmission rod, said rod mounting means, said sleeve moving means, said shaft rotating means, said rod moving means, and said pusher means.

15. A machine for using strips of material wound in reels as claimed in claim 14 wherein said first and second base portions are located side-by-side, with said first supporting bar and said second supporting bar being parallel to one another and laterally aligned.

* * * * *